United States Patent [19]

Buschermohle

[11] 4,177,035

[45] Dec. 4, 1979

[54] TUNNEL KILN FOR FIRING CERAMIC WARE

[75] Inventor: Gregor Buschermohle, Ibbenbueren, Fed. Rep. of Germany

[73] Assignee: Keller Ofenbau GmbH, Fed. Rep. of Germany

[21] Appl. No.: 887,385

[22] Filed: Mar. 16, 1978

[30] Foreign Application Priority Data

Jun. 10, 1977 [DE] Fed. Rep. of Germany ..... 2726199
Sep. 22, 1977 [DE] Fed. Rep. of Germany ..... 2742599

[51] Int. Cl.[2] ..... F27B 9/06
[52] U.S. Cl. ..... 432/121; 432/148; 432/239
[58] Field of Search ..... 432/121, 126, 132, 137, 432/148, 239

[56] References Cited

U.S. PATENT DOCUMENTS 1,330,223 2/1920 Turtle ..... 432/239
1,409,118 3/1922 Scanlon ..... 432/239

*Primary Examiner*—John J. Camby
*Attorney, Agent, or Firm*—Frank J. Jordan

[57] ABSTRACT

A tunnel kiln through which carriers carry ceramic ware to be fired includes an elongated tunnel having a closed bottom, a stationary flue at the bottom of the tunnel, and at least one transport way disposed in the tunnel above the stationary flue for carrying the carriers through the tunnel. The transport way comprises a support means and rolling means are provided between the support means and the carrier for rollably carrying the carriers along the transport way, whereby ceramic ware on the carriers are fired as the carriers traverse the tunnel kiln.

10 Claims, 6 Drawing Figures

TUNNEL KILN FOR FIRING CERAMIC WARE

BACKGROUND OF THE INVENTION

This invention relates to a tunnel kiln for the firing of ceramic ware wherein movable carriers for the transport of ceramic ware are moved at the bottom of the tunnel kiln through a firing tunnel.

German DT-OS 2355 555 discloses such a tunnel kiln wherein movable carriers are moved through a tunnel kiln by means of sliding carriers which rest upon slide rails or slide bars. Sand seals affixed to the tunnel kiln are intended to prevent the heat of the firing tunnel from escaping to the outside. The firing tunnel which is open underneath and which is sealed from the outer air by the sliding carrier is intended to provide sufficient cooling of the slide rails and of the sliding carriers. This cooling effect is supposed to be sufficient for short transit times, but for longer transit times cooling means, particularly ventilators, are disposed at the open bottom of the tunnel kiln in order to keep the slide rails and slide carriers cool.

A disadvantage of these well known tunnel kilns is that the carriers can only be fired from above. Accordingly, since even distribution of heat is a requirement, a prolonged transit time in the firing tunnel is required.

Furthermore, it is a disadvantage that the carriers must be made out of steel which is protected by insulating material. Because the carriers are intensely heated during the transit through the firing tunnel and also are exposed to high temperatures in the area of the sand seals, such steel structures are subjected to increased temperature stresses. Therefore such steel structures undergo warping and deformation which effect a shortening of the life expectancy of the carriers.

Furthermore, the insulating means are characterized by poor stability when subjected to temperature changes and are subject to poor wear stability.

The transit time in which a carrier traverses the firing tunnel depends on the thickness of the insulating means. Thinly held insulation means thus cause a short transit time in order to prevent considerable destruction of the carriers. The movement of the carriers through the kiln cannot be interrupted when interruptions in the production of ware to be fired occur. Therefore, carriers without firing ware are introduced in the kiln in order to keep the transit times constant. It is quite obvious that heat losses occur because the ware-free carriers absorb the heat.

Due to the lateral insulation between the carrier and kiln wall the width of the firing tunnel is so reduced that only one train of carriers can traverse the kiln. The width and length of the carrier are limited because the carrier tend to warp under the influence of heat. Furthermore, the tunnel kiln is leaky because the carriers warp and the sand seals often do not exclude all the outer air, so that ambient outer air is drawn in at leaky spots, for example, where two carriers abut or between the carriers and the tunnel wall. That causes loss of heat.

For the return transport of carriers from the exit end to the entrance end expensive by-passes are required to be built.

Another disadvantage of the heretofore known tunnel kilns is that lubrication has to be applied between the slide bars and slide runners, necessitating the introduction of lubrication stations at appropriate distances. The maintenance of these is also expensive.

Accordingly, one object of the present invention is to overcome the aforesaid disadvantages of known prior art tunnel kiln arrangements and to provide a tunnel kiln with a carrier movable through the firing tunnel wherein the temperature is advantageously distributed through the whole firing tunnel, and wherein the firing tunnel is completely insulated from the outer air. Furthermore, the carriers to be transported through the firing tunnel are made without temperature sensitive steel parts and lubrication is not required.

These objectives are achieved, according to the invention by providing a tunnel kiln having an oven floor with a closed botton and a stationary floor flue with at least one transport way arranged on the floor flue, the transport way serving to move the carriers through the firing tunnel, the transport way consisting of support plates and rolls or balls which roll upon the support plates with the carriers being supported by the rolls or balls.

The fact that the tunnel kiln is provided with a closed bottom and a stationary disposed bottom flue permits the firing tunnel to be heated by burners operable in the vicinity of the bottom flue and by burners functioning directly inside the firing space. This results in an advantageous distribution of heat in the firing tunnel which has an advantageous influence upon the transit time of the carriers through the tunnel kiln. The stationary bottom flue also permits the constant introduction into the free space near the flue supports of the combustion gases of the burners, operable within the area of the bottom flues, so that the combustion gases may rise upwardly all over the breadth of the firing tunnel.

No heat losses by drawing in external air can occur because the tunnel kiln is completely free of leaks.

The carriers may be left safely inside the tunnel kiln without cooling, according to the firing time of the goods, and no damage to the carriers occurs as the carriers consist of fireproof or heat resistant material which is stable against changes of temperatures and do not contain any temperature sensitive steel parts.

That is particularly advantageous when the production of the firing ware is interrupted and the feeding of the new ware lags. The tunnel kiln may now be shut at its highest temperature and will be ready for production even after several hours inactivity.

The dense, airtight construction of the tunnel kiln makes it possible to build the firing tunnel at an arbitrary width so that it may accept several transport ways side by side. The particular arrangement of the transport ways and of the carriers, and the cooperative arrangement of these allows always an optimal support for the firing ware.

Applicant's invention provides for reducing the pushing power required to move the carriers through the tunnel kiln as much as possible while preventing oblique movements of the carriers. This objective is achieved by furnishing the supporting plates and the carriers with grooves within which the balls or short rolls move. The grooves are positioned at the longitudinal faces of the support plates and carriers, the longitudinal faces running in the direction of the firing tunnel.

The rolls whose dimensions correspond to that of the balls, roll in the grooves with very low friction, so that a lower pushing force is able to move the carriers through the tunnel kiln.

Due to the fact that the balls or rolls are guided in the grooves, an oblique running of the carriers cannot occur, and the disadvantages resulting therefrom are precluded.

The small size of the balls and the short rolls causes an improved stability against changes of temperature. The balls and the rolls may be used for prolonged periods of time without requiring to be replaced.

The grooves for the balls may be semi-circular or angular and the grooves for the rolls may be oblong. Additional advantages of the invention are that the supporting plates in the area of each carrier-groove may be replaced by two pipes made of a fire resistant material which extends through the tunnel kiln, the two pipes serving as rolling surfaces for the balls and being disposed at a distance from each other and in recesses of the cover of the bottom flue.

The use of pipes as rolling surfaces is very economical because they are simpler to manufacture than supporting plates which are usually prepared by an extrusion process. Pipes also use less material than plates.

The pipes offer another advantage because a turn along their longitudinal axis creates a new running surface for the balls when so needed due to wear.

The material rubbed off the running surfaces of the pipes does not remain where it occurs but falls down between the pipes because the pipes are disposed at a distance from each other. This prevents prolonged damage to the pipes.

Additional work which is required when an automatic operation is desired, is small because the balls are easily transported in an inclined groove from the exit end of the kiln to the entry of the kiln in order to be reused again.

No by-passes are needed to transport the carriers from the exit end to the entrance end of the tunnel kiln. The carriers can be transported one on top of the other. Likewise there is no need for large spaces to store the carriers because they are easily stacked.

Another advantage is the small need for maintenance because no lubrication stations are needed.

Other features which are considered characteristic of the invention are set forth in the appended claims.

Although the invention is illustrated and described in relationship to specific embodiments, it is nevertheless not intended to be limited to the details shown, since various modifications and structural changes may be made therein without departing from the spirit of the invention and within the scope and range of equivalents of the claims.

The construction and operation of the invention, however, together with additional objects and advantages thereof will be best understood from the following description of specific embodiments when read in connection with the accompanying drawings.

DESCRIPTION OF THE PREFERRED EMBODIMENTS

Figure 1:
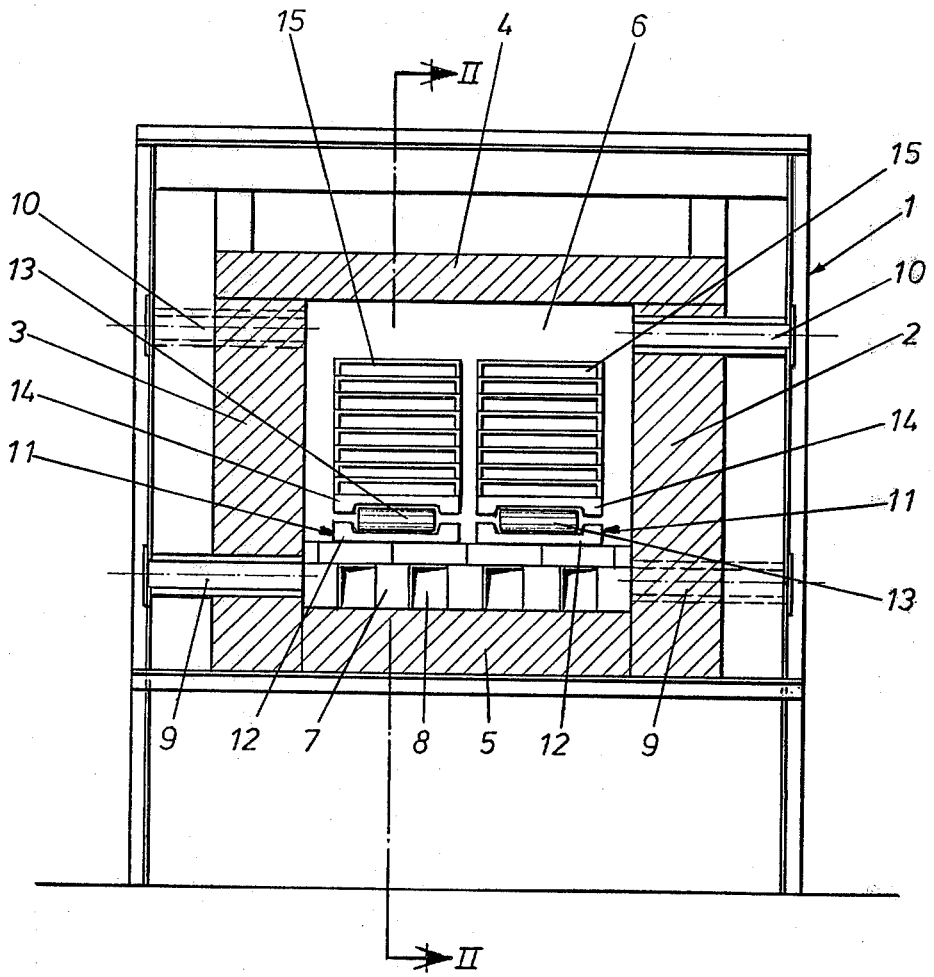
FIG. 1 is a cross sectional view through a tunnel kiln taken along the line I—I in FIG. 2.
Figure 2:
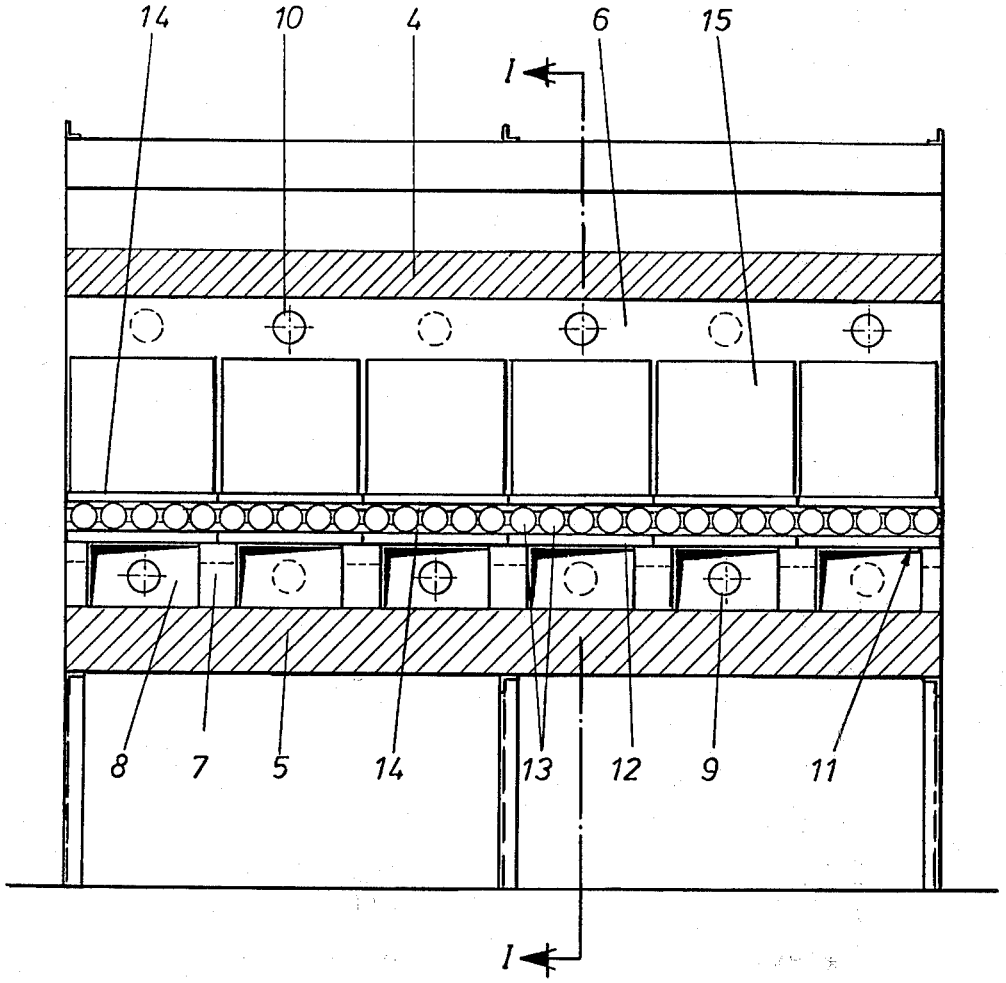
FIG. 2 is a longitudinal sectional view through the tunnel kiln taken along the line II—II in FIG. 1.

Referring to FIGS. 1 and 2 of the drawings there is shown a tunnel kiln 1 consisting of side walls 2 and 3, a roof 4 and bottom or floor 5 which define a firing tunnel 6. A stationary bottom flue 7 is disposed upon the kiln floor 5. The bottom flue 7 is partially formed by the floor 5 and extends through the entire firing tunnel 6. Within the bottom flue 7 are arranged chambers 8 which are connected to burner tubes 9 and the firing tunnel 6. Burner tubes 10 also open into the firing tunnel 6.

Two transport ways 11 are disposed side by side upon the bottom flue 7 and extend through the firing tunnel 6. In the embodiment of FIGS. 1 and 2 the transport ways 11 consist of U-shaped, adjoining support plates 12, the legs or bars of which face upwardly as shown in FIG. 1. The support plates 12 are made of fireproof or heat resistant material and accept adjoining rolls 13 also made of fireproof or heat resistant material. Balls may also be used instead of the rollers 13 as will be described in greater detail hereinafter.

The rolls 13 roll on the support plates 12 and carry carriers 14 loaded with ware to be fired or firing ware 15. The carriers 14 are transported through the firing tunnel 6 by aid of the rolls 13. The carriers 14 are made of fireproof or heat resistant material and are of an inverted U-shaped construction as shown in FIG. 1. The legs or bars of the carriers 14 face downwardly in the direction of the legs or bars of the support plates 12 and thus confine or form guides for the rolls 13.

The support plates 12 and the carriers 14 have the same size and may be exchanged with each other.

Upon arriving at the exit of the firing tunnel 6, the carriers 14 are stacked after the removal of the firing ware 15 and brought back to the entrance end of the tunnel kiln 1 so that they may be used again.

The rolls 13 which move with the carriers 14 through the firing tunnel 6 are also collected at the exit end of the tunnel kiln 1 and transported again to the entrance end.

Figure 3:
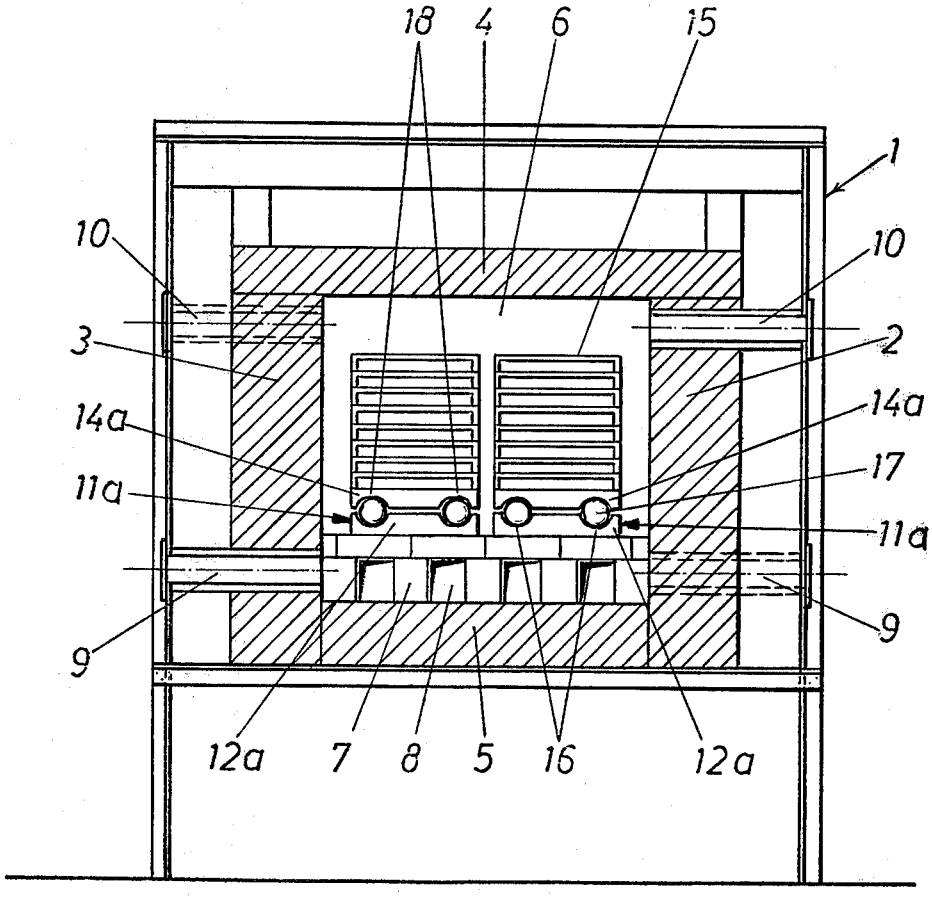
FIG. 3 is a cross sectional view through a tunnel kiln according to another embodiment.
Figure 4:
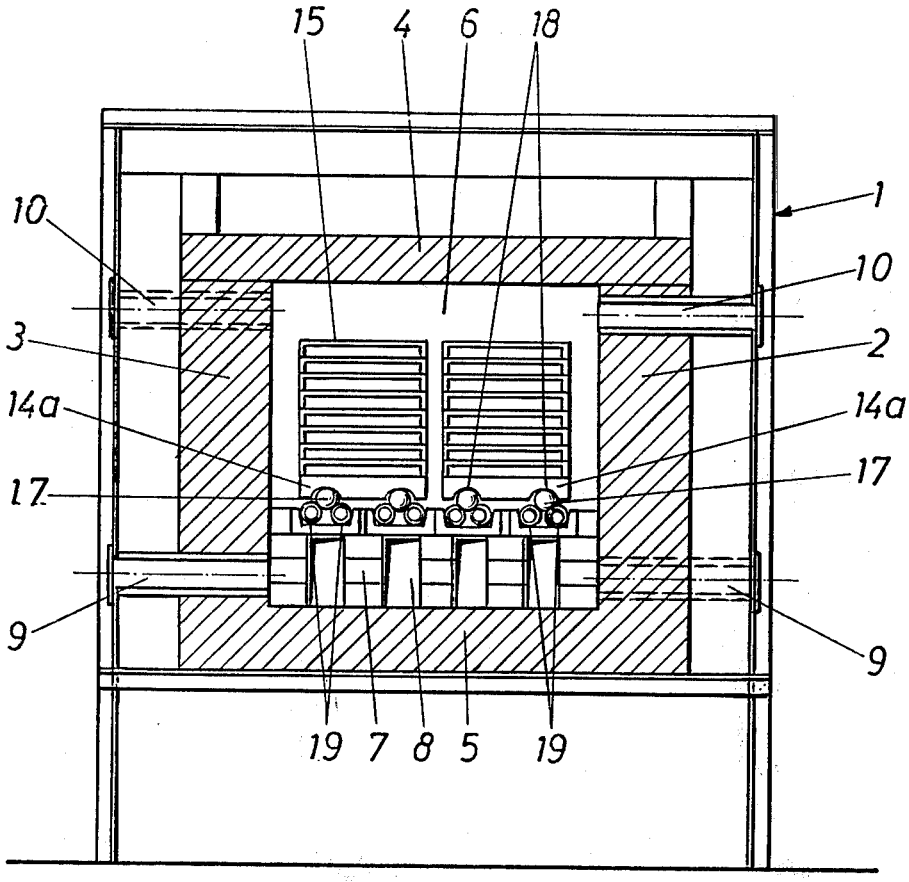
FIG. 4 is a cross sectional view through a tunnel kiln according to a further embodiment.

In the alternate embodiments shown in FIGS. 3 and 4 the numerals used in FIGS. 1 and 2 have been used again to designate the same parts. Thus in the embodiment of FIGS. 3 and 4 there is shown a tunnel kiln 1 consisting of side walls 2, 3, roof 4 and bottom or floor 5 defining the firing tunnel 6. The bottom flue 7 which is partially formed by the floor 5 extends through the entire firing tunnel 6 and includes chambers 8 which are connected to the burner tubes 9 and the firing tunnel 6. Also the burner tubes 10 open into the firing tunnel 6.

Transport ways 11*a* are disposed side by side upon the bottom flue 7 and extend through the firing tunnel 6. The transport ways 11*a* consist of adjoining supporting plates 12*a* (FIG. 3), which are provided with continuous longitudinal grooves 16 disposed on the upper faces of the supporting plates 12*a*. The longitudinal grooves 16 extend in the longitudinal direction of the firing tunnel 6. The grooves 16 are made of fire resistant material and accept balls 17, the dimension of such rolls conforming to the dimensions of the balls 17. The grooves 16 for the balls 17 may have a semi-circular or angular configuration.

The balls 17 roll in the grooves 16 and carry carriers 14*a* which are also furnished with grooves 18, the grooves 18 being disposed opposite the grooves 16, thus allowing the balls 17 to engage both grooves 16 and 18. The carriers 14*a* are loaded with the firing ware 15 and are transported through the firing tunnel 6 by a pushing force pressing against the carriers 14*a* aided by the balls 17 rolling in the grooves 16 and 18.

The supporting plates 12*a* and the carriers 14*a* have the same dimensions and may be interchanged with each other.

Instead of the supporting plates 12*a* as shown in FIG. 3, an arrangement may be provided as shown in the alternate embodiment of FIG. 4 wherein pipes 19 are used to serve as the rolling surface for the balls 17. As shown in FIG. 4 two parallel pipes 19 are disposed upon the bottom flue 7 in the area underneath each grooves 18 and extend to a length corresponding to the length of the tunnel kiln. The pipes 19 are disposed at a distance from each other so that the abraded dust caused by the balls 17 may fall between the pipes 19 such that the pipes 19 will not be damaged.

In order to hold the pipes 19 in place, the pipes 19 are disposed in recesses of the bottom flue cover. The pipes 19 may also be fastened to the bottom flue cover by projections.

The carriers 14*a* are returned to the inlet end of the tunnel kiln 1 for repeated use after arriving at the exit end of the tunnel kiln, and after removal of the fired ware.

The balls 17 or the short rolls, which have moved with the carriers 14*a* through the tunnel kiln 1 are brought back to the entrance end by appropriate means, for instance grooves.

Figure 5:
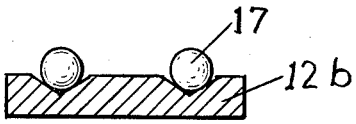
FIG. 5 is a fragmentary view showing an alternate arrangement of the support plate.

FIG. 5 shows an alternate arrangement wherein the support plates 12*b* are provided with V-shaped grooves in which the balls 17 are accommodated.

Figure 6:
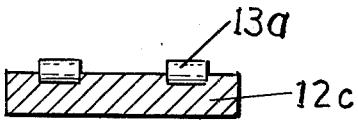
FIG. 6 is a fragmentary view showing another alternate arrangement of the support plate.

FIG. 6 shows an arrangement wherein the support plate 12*c* is provided with grooves of rectangular cross section in which short rolls 13*a* are accommodated.

The fireproof material of the transport ways 11, carriers 14, rollers 13, balls 17 and pipe 18 may be made of fire clay, fire brick and/or aluminum oxide material.

I claim:

1. A tunnel kiln through which carriers carry ceramic ware to be fired comprising elongated tunnel means having a closed bottom, a stationary flue at the bottom of said tunnel means, at least one transport way disposed in said tunnel means above said stationary flue, carriers carried by said transport way through the tunnel means, said transport way comprising a support means, and rolling means between said support means and said carrier for movably carrying said carriers along said transport way, said support means comprising a pair of spaced and elongated cylindrical members having their longitudinal axes disposed parallel to the elongated tunnel means, said rolling means rolling on said spaced cylindrical members.

2. A tunnel kiln according to claim 1 wherein said cylindrical members are pipes.

3. A tunnel kiln according to claim 1 wherein said rolling means are spherical balls rollably supported between said spaced and elongated cylindrical members.

4. A tunnel kiln according to claim 1, wherein said stationary flue has a top wall having grooves therein, said elongated cylindrical members being disposed in said grooves.

5. A tunnel kiln through which carriers carry ceramic ware to be fired comprising elongated tunnel means defined by side walls joined to a roof and a floor, a stationary flue disposed in said tunnel means on said floor, said stationary flue extending through the longitudinal length of the tunnel means and being partially defined by said floor, said stationary flue having hollow chambers therein which are in communication with said tunnel means, said side walls of said tunnel means having openings receiving burner tubes, said burner tubes communicating with said chambers in said stationary flue such that heating medium passes from the heating tubes to said hollow chambers and thence to the interior of said tunnel means, at least one transport way disposed in said tunnel means on said stationary flue for movably supporting said carriers as the carriers move through the tunnel means, and rolling means between said transport means and said carrier for movably carrying said carriers along said transport way.

6. A tunnel kiln according to claim 5 wherein said transport way comprises a support plate disposed on said stationary flue, said support plate having a generally U-shaped groove, said carrier having a bottom part having an inverted generally U-shaped groove, said rolling means being disposed within the U-shaped groove in the support plate and in the inverted U-shaped groove in the bottom part of the carrier.

7. A tunnel kiln according to claim 6 wherein said support plate has spaced upstanding leg portions defining said U-shaped groove, said bottom part of said carrier having spaced downwardly depending leg portions defining said inverted U-shaped groove, said upstanding legs being disposed opposite said downwardly depending leg portions, said rolling means being disposed between said leg portions.

8. A tunnel kiln according to claim 5 wherein said support plate, said rolling means, and said carriers are made of a heat resistant material.

9. A tunnel kiln according to claim 5 wherein said support plate comprises means defining elongated grooves of rectangular cross sectional configuration in which said rolling means are guided.

10. A tunnel kiln according to claim 5 wherein said carriers have a bottom part having elongated grooves in which said rolling means are accommodated.

* * * * *